United States Patent [19]

Bruegge et al.

[11] Patent Number: 5,061,392

[45] Date of Patent: Oct. 29, 1991

[54] METHOD OF MAKING PASTE DETERGENT AND PRODUCT PRODUCED

[75] Inventors: Anthony J. Bruegge, Cincinnati; Denny E. Daugherty, West Chester, both of Ohio

[73] Assignee: DuBois Chemicals, Inc., Cincinnati, Ohio

[21] Appl. No.: 476,297

[22] Filed: Feb. 7, 1990

[51] Int. Cl.[5] ..... C11D 11/00; C11D 3/06; C11D 17/00

[52] U.S. Cl. ..... 252/135; 252/103; 252/156; 252/174; 252/174.14; 252/187.24; 252/187.25; 252/87.187.26; 252/DIG. 14

[58] Field of Search ..... 252/156, 135, 174, DIG. 14, 252/103, 187.24, 187.25, 187.26, 174.14

[56] References Cited

U.S. PATENT DOCUMENTS

| | | | |
|---|---|---|---|
| Re. 32,818 | 1/1989 | Fernholz et al. | 252/90 |
| 3,535,258 | 10/1970 | Sabatelli | 252/105 |
| 4,147,650 | 4/1979 | Sabatelli | 252/103 |
| 4,680,134 | 7/1987 | Heile et al. | 252/160 |
| 4,681,696 | 7/1987 | Bruegge et al. | 252/99 |
| 4,681,914 | 7/1987 | Olson et al. | 252/91 |
| 4,725,376 | 2/1988 | Copeland | 252/90 |
| 4,753,755 | 6/1988 | Gansser | 252/527 |
| 4,808,236 | 2/1989 | Davis, Jr. | 134/25.2 |

*Primary Examiner*—Paul Lieberman
*Assistant Examiner*—A. Beadles-Hay
*Attorney, Agent, or Firm*—Wood, Herron & Evans

[57] ABSTRACT

A method of forming a paste detergent composition includes forming two separate aqueous solutions. The first aqueous solution includes an effective concentration, generally 1 to 70% of potassium tripolyphosphate. The second solution is an aqueous solution of a water soluble sodium based detergent builder preferably sodium hydroxide. These are combined and due to the effective concentrations of the potassium tripolyphosphate and the water soluble detergent builder, the viscosity of the formed detergent substantially increases relative to either of the viscosities of the first or second aqueous solutions. This provides a unique method of forming paste detergent compositions particularly for use in warewashing machines.

19 Claims, No Drawings

METHOD OF MAKING PASTE DETERGENT AND PRODUCT PRODUCED

BACKGROUND OF THE INVENTION

There are many types of detergents which are employed for different applications. The physical forms of these detergents include various liquids, solids, and powders. High performance detergents such as mechanical warewashing detergents, must meet end use criteria. Therefore certain physical forms may be required. With certain detergents, it is desirable to have a paste or a solid detergent as opposed to a powder or a liquid.

Formation of liquid detergents is generally not difficult since the components can be easily mixed to form the end product. Although there are many complex variations, powdered detergents can be formed by simply mixing the granular detergent components together. These, however, are unsuitable for many applications. Liquid detergents may not have sufficient concentration to perform the function required. Powdered detergents are difficult to dispense in a uniform manner due to the variable rates of solution of the components, settling and so on.

Solid and paste detergents can be used to overcome the problems encountered with liquids and powders. However, these are more difficult to produce and solids have several arguable disadvantages. Solids can be formed by simply compressing granular detergents together. However, these are unsuitable for many applications due to the irregularity in the rate of dissolution of the components as well as the strength of the product.

Solid and paste detergents can be formed by combining hydratable detergents with water. The viscosity increases by hydration of the detergent components or the use of thickeners. If a sufficient concentration of hydratable detergent is added, the detergent solidifies.

With this hydration process, the components can actually set in the mixing vessel which requires an inordinate amount of time and effort to clean. Further, hydration is generally an exothermic reaction. When detergents are formed and their viscosity increases due to hydration, a great deal of heat must be dissipated.

In many applications, heat must even be added and then removed from the system. For example, Fernholz U.S. Pat. No. RE 32,818 discloses supersaturating an aqueous solution with hydratable detergent compositions under elevated temperatures to permit formation of a settable detergent. This is an extremely inefficient method of manufacturing a detergent. The requirement that the detergent be heated initially requires an expenditure of energy. Further, it must be maintained in an elevated temperature until dispensing. After dispensing a great deal of heat again must be removed from the formed detergent.

Solid detergents formed by the method disclosed in the Fernholz patent also have significant use disadvantages. They are generally used by spraying water against the solid detergent to dissolve the detergent. As the detergent dissolves, chunks can break off and interfere with the operation of the warewashing machine. Further, as it dissolves, due to a decrease in size and the rate of dissolution, the concentration of the detergent composition be too low to meet use requirements.

There are other patents which discuss formation of solid detergents such as Heile U.S. Pat. No. 4,680,134, Gansser U.S. Pat. No. 4,753,755, Olson U.S. Pat. No. 4,681,914, Davis U.S. Pat. No. 4,808,236, and Copeland U.S. Pat. No. 4,725,376.

Paste detergents do not suffer from many of the problems associated with the manufacture and use of solid detergents. Sabatelli U.S. Pat. No. 4,147,650 discloses several paste detergents that have particularly strong, self-supporting structures. Further, Bruegge U.S. patent application 171,759, filed Mar. 22, 1988 and Bruegge U.S. Pat. No. 4,681,696 disclose paste detergents. None of these provide a simple easy method of forming a highly viscous paste detergent.

SUMMARY OF THE INVENTION

Accordingly, it is an object of the present invention to provide an improved method of forming a viscous paste detergent composition.

It is particularly an object of the present invention to provide such a method which reduces or eliminates mixing problems including requirements of heating, dissipation of heat and avoids potential setting of the components during mixing.

According to a preferred embodiment, it is an object of the present invention to form a detergent composition wherein the detergent composition is mixed and formed in the container in which it is distributed. Thus it cannot set in the mixing vessel.

It is also an object of the present invention to provide a method of forming a paste detergent which does not require handling of highly viscous fluids.

These objects and advantages are obtained by forming a first solution which is an aqueous solution of potassium tripolyphosphate along with potentially other detergent builders which are in solution at room temperature. A second aqueous solution of one or more sodium based water soluble compositions is formed. These two solutions are mixed at room temperature preferably in a disposable container. The combination of the sodium based water soluble composition and potassium tripolyphosphate at their effective concentrations causes a dramatic increase in the viscosity of the formed detergent composition providing a highly viscous detergent composition even though the two component solutions have relatively low viscosities before mixing.

Alternatively, the two component solutions can be combined in an extruder and the formed detergent extruded as a defined shape. This permits a detergent having a unique cross-sectional configuration to be formed continuously or semi-continuously.

Other objects and advantages of the present invention will be appreciated in light of the following detailed description.

DETAILED DESCRIPTION

A highly viscous detergent composition is formed by combining a first aqueous solution of potassium tripolyphosphate and optionally other detergent builders with a second aqueous solution which contains sodium based water soluble compositions. Upon combination, the viscosity of these two solutions substantially increases. The viscosity of the formed detergent is controlled by controlling the concentration of the potassium tripolyphosphate builder as well as the concentration of the sodium based water soluble composition.

The term "solid" herein defines a detergent whose shape cannot be altered without physically crushing the detergent. It contains no physically detectable free water and will not permit an object to pass through it without physically breaking or destroying the detergent.

A paste is a material which is thixotropic and is not a solid at room temperature. It is generally homogeneous and has a viscosity of at least about 20,000 and preferably 50,000 centipoise at 20° C. as determined by a rotational viscometer at a spindle speed of 5 revolutions per minute. As measured by a penetrometer a paste has an unconfined compressive strength of from 0.07Kg/cm$^2$ to 2.2Kg/cm$^2$. It generally includes free water. If one were to attempt to pass an object through a paste, it could be easily inserted into the paste. A highly viscous paste may be self-supporting, i.e., its shape would not be substantially altered by mere gravitational forces.

In this description, percentages are percentages by mass and include water. The percentages may be the percentage of either the first solution or second solution or the percentage of the combined first and second solution. If the percentage is that of the combined first and second solutions, the percentage is indicated as that of the formed detergent composition.

The term solution as used herein is defined broadly and includes true solutions as well as partial suspensions of water soluble compositions wherein the water soluble composition is partially in solution and is partially suspended. As will be discussed further, a true solution is definitely preferred for use in the present invention but is not absolutely critical.

To form the paste detergent of the present invention, the first aqueous solution of detergent components is formed. In addition to water, the primary component of the first solution is potassium tripolyphosphate and preferably includes additional water soluble detergent builders and components.

Additional builders that can be present in this first solution are the typical active and inert builders and detergent components that would be used in detergent compositions. These include sequestering agents such as alkali metal pyrophosphates, generally tetrasodium pyrophosphates, pentasodium tripolyphosphates, sodium or potassium hexametaphosphate, builders such as alkali metal gluconates, carbonates, borax, alkali metal sulfates, silicates and metasilicates, active chlorine sources, low molecular weight polyelectrolytes, surfactants, as well as other water soluble detergent components.

The gluconate is employed as a builder and sequesterant. It is particularly required in formulations to sequester hardness ions when a dilution system dispenser is employed. Generally sodium or potassium gluconate and sodium or potassium glucoheptonate are preferred.

In addition to the gluconate, the detergent composition can include an additional sequestering agent, specifically a low molecular weight polyelectrolyte, the preferred being polyacrylic acid.

Low molecular weight polyelectrolytes useful in the present invention generally have a molecular weight of about 1500 to 15,000 and preferably 4–12,000. These are specifically required to sequester hardness ions in high temperature applications, particularly to sequester formed orthophosphates during use. Typically used polyelectrolytes are also disclosed in Sabatelli U.S. Pat. No. 4,147,650.

The composition may also include a nitrogen free sequesterant. These are used because nitrogen containing sequesterants could react with the chlorine source. If no chlorine source is employed, other sequesterants can be used.

Nitrogen free sequestrants include polyvalent phosphonic acids such as methylene, diphosphonic acid or polyvalent phosphono carboxylic acids such as 1,1-diphosphono propane-1,2-dicarboxylic acid, 1-phosphono propane-1,2,3-tricarboxylic acid or the preferred 2-phosphono butane-2,3,4-tricarboxylic acid and their sodium or potassium salts.

Active chlorine sources are disclosed, for example, in Bruegge U.S. Pat. No. 4,681,696. The chlorine source can be a combination of a sulfonamide, such as Chloramine-T, with an active chlorine source such as a hypochlorite. The sulfonamide is not necessarily required. When a hypochlorite is employed, a slight amount of sodium hydroxide can be included to stabilize the hypochlorite.

The concentration of the components of the first solution will be basically less than saturated, incorporating at least in part potassium tripolyphosphate. It is preferred that the concentration of the components in this first solution be low enough that the solution remains clear. Although a cloudy solution will function, the final product is less consistent.

The first solution must have a concentration of potassium tripolyphosphate which is effective to cause an increase in viscosity of the final detergent composition when combined with the second solution. Of course the effective concentration of potassium tripolyphosphate will vary somewhat depending on the concentration of the second solution. However, generally the concentration of potassium tripolyphosphate in the first solution will range from 1% to about 70% of the first solution by mass. The concentration of the additional detergent components in the first solution can vary from 0% to less than about 25% by mass of the first solution. If the concentration of these components exceeds 25%, they generally will not go into solution and will settle out of the solution; or they may form a viscous slurry or even solidify.

The second solution used to form the present invention is a concentrated solution of one or water soluble sodium compositions. Suitable water soluble sodium compositions include sodium hydroxide, sodium carbonate, sodium metasilicate, sodium chloride, sodium phosphates, sodium sulfates, sodium borates and the like. In the preferred embodiment, the water soluble sodium composition would be sodium hydroxide which would increase the alkalinity of the formed detergent.

The concentration of the water soluble sodium compositions must be effective to cause a significant increase in viscosity when combined with the first solution. This will, of course, vary depending on the particular sodium composition used. However, generally the concentration must be at least 15% by weight of the second solution. Further, it cannot exceed the solubility limit of the composition in water.

Generally sodium hydroxide remains as a low viscosity solution up to a concentration of about 50%. When an excess of 50% is employed, the solution tends to solidify at room temperature. Generally the concentration of sodium hydroxide present in the second solution should be effective to cause significant increase in viscosity when combined with the first solution. This will generally be about least about 15% by mass of the second solution. Thus the concentration of sodium hydroxide in the second solution can be from about 15% to about 50% by mass of the second solution. The total concentration in NaOH (solid) of the formed detergent can range from about to about 45%.

The detergent of the present invention is formed by combining the first and second solutions at less than 1.00° C. generally at room temperature about 15° to 30° C. When they are combined, a dramatic increase in viscosity occurs. Depending on the concentration of the components, particularly sodium hydroxide, potassium tripolyphosphate and free water, the viscosity of the formed paste can vary substantially.

The first and second solutions are preferably combined by injecting them at relatively high pressures into a container which is adapted to be used in a washing machine, such as a warewashing machine. The two solutions when simultaneously injected into a container, mix and upon mixing their viscosity increases dramatically. Generally there is a viscosity increase of at least 10 fold. Depending on the concentration of the relative components, the end product can be an extremely viscous paste or a solid detergent. When mixed, the two solutions produce relatively little heat. An exotherm of 20° F. is typically noted. The maximum viscosity is reached in a time span of less than 1 minute up to 12 hours.

Alternatively, the two components can be combined in the discharge barrel of an extruder. As the viscosity increases, elongated detergent brick can be extruded and cut to a desired length.

Preferably solution A will have the following composition:

| | |
|---|---|
| Potassium tripolyphosphate | 1–70% |
| Additional Detergent Builders | 0–25% |
| Water | 30–70% |

The additional detergent components can include the following:

| | | Preferred |
|---|---|---|
| Chloramine T or other sulfonamide | 0–5% | 0–3% |
| Hypochlorite or Other active chlorine source | 0–10% | 0–5% |
| Sodium tripolyphosphate | 0–20% | 0–12.5% |
| Sodium pyrophosphate | 0–20% | 3–12% |
| Other phosphates | 0–10% | 1–5% |
| Polyelectrolyte | 0–9% | 1–4% |
| Carbonate | 0–15% | 0–5% |
| Defoamer | 0–5% | 0–3% |
| Surfactant | 0–30% | 0–8% |
| Gluconate | 0–8% | 0–2% |
| Sulfate | 0–15% | 0–5% |
| Borax | 0–15% | 0–5% |
| Phosphonate | 0–10% | 0–5% |
| Sodium Chloride | 0–15% | 0–5% |
| Silicates | 0–20% | 5–15% |

In a preferred embodiment, the present invention will include the following components:

| | % TOTAL FORMED DETERGENT |
|---|---|
| FIRST SOLUTION | |
| Water (deionized) | 40.2 |
| Polyacrylic Acid (48%) | 2.0 |
| Potassium polyphosphate | 9.5 |
| Sodium tripolyphosphate | 12.5 |
| Chloramine-T | 1.8 |
| 50% Sodium Hydroxide | 2.0 |
| Sodium Hypochlorite (13% aqueous solution) | 4.0 |
| SECOND SOLUTION | |
| Sodium hydroxide (50% aqueous solution) | 28.0 |

-continued

The first solution is combined with the second solution in a ratio of 72/28 as indicated by the above percentages to form the detergent composition of the present invention. Solution A as formulated is a clear aqueous solution and the second solution is also a clear aqueous solution. When combined, their viscosity increases until a self-supporting paste is formed.

In the following examples, the individual components, are listed according to their percentage of the total detergent composition by mass. The components listed under first composition "A" are mixed together. The components listed under second composition "B" are also combined together. In most of these examples, the second solution is simply an aqueous solution of sodium hydroxide and the percentage NaOH is given. These two compositions are combined to form the final detergent composition.

EXAMPLE 1

The first detergent composition included the following:

| A | |
|---|---|
| Deionized water | 58.5% |
| Potassium tripolyphosphate | 9.5% |
| Sodium tripolyphosphate | 12.5% |
| NaOH (50% solution) | 2.0% |
| NaOCl (13% available chlorine) | 8.0% |

The second solution was the following:

| B | |
|---|---|
| NaOH (50% aqueous solution) | 9.0% |

Composition A was mixed with composition B and the product set up to a firm paste.

EXAMPLE 2

The first composition included the following:

| A | |
|---|---|
| Deionized water | 49.0% |
| Potassium tripolyphosphate | 9.5% |
| Sodium tripolyphosphate | 12.5% |
| NaOH (50% solution) | 2.0% |
| NaOCl | 8.0% |

The second detergent composition included the following:

| B | |
|---|---|
| NaOH (25% solution) | 19.0% |

Composition A was combined with composition B. The product set as a paste in about 20 minutes.

EXAMPLE 3

The first solution included the following:

| A | |
|---|---|
| Deionized water | 59.5% |
| Potassium tripolyphosphate | 9.5% |
| Sodium tripolyphosphate | 12.5% |
| NaOH (50% solution) | 2.0% |
| NaOCl (13%) | 8.0% |

The second solution included the following:

| B | |
|---|---|
| NaOH (50% solution) | 8.5% |

Composition A was combined with composition B and the product crystallized to form a very loose paste.

EXAMPLE 4

The first solution included the following:

| A | |
|---|---|
| Deionized Water | 40.0% |
| Potassium tripolyphosphate | 9.5% |
| Sodium tripolyphosphate | 12.5% |
| NaOH (50% solution) | 2.0% |
| NaOCl | 8.0% |

The second solution included:

| B | |
|---|---|
| NaOH (50% solution) | 28.0% |

Composition A was combined with composition B and the formed detergent set up to a paste immediately.

EXAMPLE 5

The first solution included the following:

| A | |
|---|---|
| Deionized Water | 54.0% |
| Potassium tripolyphosphate | 9.5% |
| Sodium tripolyphosphate | 12.5% |
| NaOH (50% solution) | 2.0% |
| NaOCl | 8.0% |

The second solution included:

| B | |
|---|---|
| NaOH (50% solution) | 14.0% |

Composition A was combined with composition B and set up to a paste in approximately 30–45 seconds.

EXAMPLE 6

The first solution included the following:

| A | |
|---|---|
| Deionized water | 57.5% |
| Potassium tripolyphosphate | 9.5% |
| Sodium tripolyphosphate | 12.5% |
| NaOH (50% solution) | 2.0% |
| NaOCl | 8.0% |

The second solution included:

| B | |
|---|---|
| NaOH (50% solution) | 10.5% |

Solution A was combined with solution B. After 5 minutes, the combined detergent was a cloudy liquid. After 15 minutes, a paste formed.

EXAMPLE 7

The first solution included the following:

| A | |
|---|---|
| Deionized water | 40.0% |
| Potassium tripolyphosphate | 9.5% |
| Sodium tripolyphosphate | 12.5% |
| NaOH (50% solution) | 2.0% |
| NaOCl | 8.0% |

The second solution included:

| B | |
|---|---|
| NaCl (35.7% aqueous solution) | 28.0% |

Composition A was combined with composition B and a paste was formed.

The following examples list the detergent components in their respective solutions A and B. In each of the examples, solution A and solution B were combined and the consequences of the combination are disclosed in the individual examples.

EXAMPLE 8

| | |
|---|---|
| A | |
| Deionized water | 40% |
| Potassium tripolyphosphate | 9.5% |
| Sodium tripolyphosphate | 12.5% |
| Sodium hydroxide (50% solution) | 2.0% |
| NaOCl (13% solution) | 8.0% |
| B | |
| NaOH (50% solution) | 28.0% |

Set up to a paste.

EXAMPLE 9

| | |
|---|---|
| A | |
| Deionized water | 54.0% |
| Potassium tripolyphosphate | 9.5% |
| Sodium tripolyphosphate | 12.5% |
| NaOH (50% solution) | 2.0% |
| NaOCl (13%) | 8.0% |
| B | |
| NaOH (50% solution) | 14.0% |

Set up to a paste.

EXAMPLE 10

| | |
|---|---|
| A | |
| Deionized water | 53.0% |
| Potassium tripolyphosphate | 8.2% |
| Sodium tripolyphosphate | 10.9% |
| NaOH (50%) | 1.7% |
| NaOCl (13%) | 7.0% |

-continued

| | |
|---|---|
| B | |
| NaOH (50%) | 19.1% |

This set up to a paste.

EXAMPLE 11

| | |
|---|---|
| A | |
| Deionized water | 57.5% |
| Potassium tripolyphosphate | 9.5% |
| Sodium tripolyphosphate | 12.5% |
| NaOH (50%) | 2.0% |
| NaOCl | 8.0% |
| B | |
| NaOH (50%) | 10.5% |

After 5 minutes, this was still a liquid, but cloudy with crystals. Ten minutes later a paste formed.

EXAMPLE 12

| | |
|---|---|
| A | |
| Deionized water | 40.0% |
| Potassium tripolyphosphate | 9.5% |
| Sodium tripolyphosphate | 12.5% |
| NaOH (50%) | 2.0% |
| NaOCl | 8.0% |
| B | |
| NaCl (35.7%) | 28.0% |

The two were mixed together and a paste formed.

EXAMPLE 13

| | |
|---|---|
| A | |
| Deionized water | 42.0% |
| Potassium tripolyphosphate | 9.5% |
| NaCl | 10.5% |
| NaOH (50%) | 2.0% |
| NaOCl | 8.0% |
| B | |
| NaOH (50%) | 28.0% |

Set up to a paste.

EXAMPLE 14

| | |
|---|---|
| A | |
| Deionized water | 42.0% |
| Potassium tripolyphosphate | 9.5% |
| NaCl | 10.5% |
| NaOH (50%) | 2.0% |
| NaOCl | 8.0% |
| B | |
| NaCl (35%) | 28.0% |

These formed a very loose paste in about five minutes.

EXAMPLE 15

| | |
|---|---|
| A | |
| Deionized water | 43.0% |
| Potassium tripolyphosphate | 8.5% |
| NaCl | 10.5% |
| NaOH (50%) | 2.0% |
| NaOCl | 8.0% |
| B | |

-continued

| | |
|---|---|
| NaCl (35.7%) | 28.0% |

Crystals formed, forming a loose paste.

EXAMPLE 16

| | |
|---|---|
| A | |
| Deionized water | 43.0% |
| Potassium tripolyphosphate | 8.5% |
| Sodium tripolyphosphate | 10.5% |
| NaOH (50%) | 2.0% |
| NaOCl | 8.0% |
| B | |
| NaOH (50%) | 28.0% |

This set up to a paste immediately when mixed.

EXAMPLE 17

| | |
|---|---|
| A | |
| Deionized water | 58.5% |
| Potassium tripolyphosphate | 9.5% |
| Sodium tripolyphosphate | 12.5% |
| NaOH (50%) | 2.0% |
| NaOCl (13%) | 8.0% |
| B | |
| NaOH (50%) | 9.5% |

The product set up to a paste.

EXAMPLE 18

| | |
|---|---|
| A | |
| Deionized water | 59.5% |
| Potassium tripolyphosphate | 9.5% |
| Sodium tripolyphosphate | 12.5% |
| NaOH (50%) | 2.0% |
| NaOCl (13%) | 8.0% |
| B | |
| NaOH (50%) | 8.5% |

Upon mixing crystallization occurred forming a loose paste.

EXAMPLE 19

| | |
|---|---|
| A | |
| Deionized water | 49.0% |
| Potassium tripolyphosphate | 9.5% |
| Sodium tripolyphosphate | 12.5% |
| NaOH (50%) | 2.0% |
| NaOCl (13%) | 8.0% |
| B | |
| NaOH (25%) | 19.0% |

Crystallized about twenty minute after mixing.

EXAMPLE 20

| | |
|---|---|
| A | |
| Deionized water | 43.5% |
| Potassium tripolyphosphate | 8.0% |
| Sodium tripolyphosphate | 10.5% |
| NaOH (50%) | 2.0% |
| NaOCl (13%) | 8.0% |
| B | |
| NaOH (50%) | 28.0% |

Upon mixing, a firm paste formed.

EXAMPLE 21

| | |
|---|---|
| A | |
| Deionized water | 43.7% |
| Colloids | 2.0% |
| Potassium tripolyphosphate | 9.5% |
| Soda ash | 9.0% |
| Chloramine-T | 1.8% |
| NaOH (50%) | 2.0% |
| NaOCl (13%) | 4.0% |
| B | |
| NaOH (50%) | 28.0% |

Upon mixing, a very firm paste formed.

EXAMPLE 22

| | |
|---|---|
| A | |
| Deionized water | 42.4% |
| Colloids | 2.0% |
| Potassium tripolyphosphate | 9.5% |
| Sodium metasilicate | 10.3% |
| Chloramine-T | 1.8% |
| NaOH (50%) | 2.0% |
| NaOCl (13%) | 4.0% |
| B | |
| NaOH (50%) | 28.0% |

Upon mixing, a paste formed which was not totally consistent.

EXAMPLE 22

| | |
|---|---|
| A | |
| Deionized water | 44.5% |
| Potassium tripolyphosphate | 7.0% |
| Sodium tripolyphosphate | 10.5% |
| NaOH (50%) | 2.0% |
| NaOCl (13%) | 8.0% |
| B | |
| NaOH (50%) | 28.0% |

Upon mixing, a paste formed with some free water. But this was firm throughout.

EXAMPLE 24

| | |
|---|---|
| A | |
| Deionized water | 45.5% |
| Potassium tripolyphosphate | 6.0% |
| Sodium tripolyphosphate | 10.5% |
| NaOH (50%) | 2.0% |
| NaOCl (13%) | 8.0% |
| B | |
| NaOH (50%) | 28.0% |

Upon mixing, a solid paste formed. Weeped when squeezed but firm.

EXAMPLE 25

| | |
|---|---|
| A | |
| Deionized water | 46.5% |
| Potassium tripolyphosphate | 5.0% |
| Sodium tripolyphosphate | 10.5% |
| NaOH (50%) | 2.0% |
| NaOCl (13%) | 8.0% |
| B | |

-continued

| | |
|---|---|
| NaOH (50%) | 28.0% |

A firm paste formed upon mixing.

EXAMPLE 26

| | |
|---|---|
| A | |
| Deionized Water | 48.5% |
| Potassium Tripolyphosphate | 3.0% |
| Sodium Tripolyphosphate | 10.5% |
| NaOH (50%) | 2.0% |
| NaOCl (13%) | 8.0% |
| B | |
| NaOH (50%) | 28.0% |

Upon mixing, a significant viscosity increase occurred and a firm paste which had a slushy appearance formed.

EXAMPLE 27

| | |
|---|---|
| A | |
| Deionized water | 50.5% |
| Potassium tripolyphosphate | 1.0% |
| Sodium tripolyphosphate | 10.5% |
| NaOH (50%) | 2.0% |
| NaOCl (13%) | 8.0% |
| B | |
| NaOH (50%) | 28.0% |

Upon mixing, a firm paste formed.

EXAMPLE 28

| | |
|---|---|
| A | |
| Deionized water | 50.5% |
| Potassium tripolyphosphate | 1.0% |
| Sodium tripolyphosphate | 10.5% |
| NaOH (50%) | 2.0% |
| NaOCl (13%) | 8.0% |
| B | |
| NaOH (50%) | 28.0% |

Upon mixing a smooth, creamy paste was formed.

EXAMPLE 29

| | |
|---|---|
| A | |
| Deionized water | 51.5% |
| Sodium tripolyphosphate | 10.5% |
| NaOH (50%) | 2.0% |
| NaOCl (13%) | 8.0% |
| B | |
| NaOH (50%) | 28.0% |

Upon mixing a soft pourable liquid suspension as opposed to a paste formed. There was about $\frac{3}{4}''$ of an inch of free standing water above this.

EXAMPLE 30

| | |
|---|---|
| A | |
| Deionized water | 49.5% |
| Potassium tripolyphosphate | 1.0% |
| Sodium tripolyphosphate | 11.5% |
| NaOH (50%) | 2.0% |
| NaOCl (13%) | 8.0% |

-continued

| B | |
|---|---|
| NaOH (50%) | 28.0% |

When mixed, a smooth viscous paste with a slight water layer on top formed.

EXAMPLE 31

| A | |
|---|---|
| Deionized water | 48.5% |
| Potassium tripolyphosphate | 1.0% |
| Sodium tripolyphosphate | 12.5% |
| NaOH (50%) | 2.0% |
| NaOCl (13%) | 8.0% |
| B | |
| NaOH (50%) | 28.0% |

Formed a smooth viscous paste with slight water layer on top.

EXAMPLE 32

| A | |
|---|---|
| Deionized water | 47.5% |
| Potassium tripolyphosphate | 1.0% |
| Sodium tripolyphosphate | 13.5% |
| NaOH (50%) | 2.0% |
| NaOCl (13%) | 8.0% |
| B | |
| NaOH (50%) | 28.0% |

Upon mixing, a pourable paste formed.

| A | |
|---|---|
| Deionized water | 48.5% |
| Potassium tripolyphosphate | 2.0% |
| Sodium tripolyphosphate | 11.5% |
| NaOH (50%) | 2.0% |
| NaOCl (13%) | 8.0% |
| B | |
| NaOH (50%) | 28.0% |

A smooth, creamy paste formed upon mixing with no water layer.

EXAMPLE 34

| A | |
|---|---|
| Deionized water | 47.5% |
| Potassium tripolyphosphate | 2.0% |
| Sodium tripolyphosphate | 12.5% |
| NaOH (50%) | 2.0% |
| NaOCl (13%) | 8.0% |
| B | |
| NaOH (50%) | 28.0% |

Upon mixing, a smooth shiny paste formed.

EXAMPLE 35

| A | |
|---|---|
| Deionized water | 46.5% |
| Potassium tripolyphosphate | 2.0% |
| Sodium tripolyphosphate | 13.5% |
| NaOH (50%) | 2.0% |
| NaOCl (13%) | 8.0% |
| B | |

-continued

| | |
|---|---|
| NaOH (50%) | 28.0% |

Upon mixing, a firm paste formed which was slightly firmer than the paste formed in Example 34.

EXAMPLE 36

| A | |
|---|---|
| Deionized water | 47.5% |
| Potassium tripolyphosphate | 3.0% |
| Sodium tripolyphosphate | 11.5% |
| NaOH (50%) | 2.0% |
| NaOCl (13%) | 8.0% |
| B | |
| NaOH (50%) | 28.0% |

Upon mixing, a paste formed which was firmer than that obtained in Example 35.

EXAMPLE 37

| A | |
|---|---|
| Deionized water | 46.5% |
| Potassium tripolyphosphate | 3.0% |
| Sodium tripolyphosphate | 12.5% |
| NaOH (50%) | 2.0% |
| NaOCl (13%) | 8.0% |
| B | |
| NaOH (50%) | 28.0% |

A soft squeezable paste set up immediately.

EXAMPLE 38

| A | |
|---|---|
| Deionized water | 45.5% |
| Potassium tripolyphosphate | 3.0% |
| Sodium tripolyphosphate | 13.5% |
| NaOH (50%) | 2.0% |
| NaOCl (13%) | 8.0% |

Solution A was a cloudy white liquid.

| B | |
|---|---|
| NaOH (50%) | 28.0% |

Upon mixing, a soft squeezable paste with a half inch of water on top was formed.

EXAMPLE 39

| A | |
|---|---|
| Deionized water | 45.5% |
| Potassium tripolyphosphate | 4.0% |
| Sodium tripolyphosphate | 12.5% |
| NaOH (50%) | 2.0% |
| NaOCl (13%) | 8.0% |
| B | |
| NaOH (50%) | 28.0% |

Upon mixing, a soft squeezable paste formed quickly.

EXAMPLE 40

A

-continued

| | |
|---|---|
| Deionized water | 44.5% |
| Potassium tripolyphosphate | 4.0% |
| Sodium tripolyphosphate | 13.5% |
| NaOH (50%) | 2.0% |
| NaOCl (13%) | 8.0% |
| B | |
| NaOH (50%) | 28.0% |

The final composition quickly yielded a flowable paste.

EXAMPLE 41

| | |
|---|---|
| A | |
| Deionized water | 44.5% |
| Potassium tripolyphosphate | 5.0% |
| Sodium tripolyphosphate | 12.5% |
| NaOH (50%) | 2.0% |
| NaOCl (13%) | 8.0% |
| B | |
| NaOH (50%) | 28.0% |

Upon mixing, a firm paste formed.

EXAMPLE 42

| | |
|---|---|
| A | |
| Deionized water | 50.5% |
| Potassium tripolyphosphate | 1.0% |
| Sodium tripolyphosphate | 10.5% |
| NaOH (50%) | 2.0% |
| NaOCl (13%) | 8.0% |
| B | |
| NaOH (50%) | 28.0% |

Upon mixing, crystalline structures appeared which eventually formed a loose paste.

EXAMPLE 43

| | |
|---|---|
| A | |
| Deionized water | 49.5% |
| Potassium tripolyphosphate | 2.0% |
| Sodium tripolyphosphate | 10.5% |
| NaOH (50%) | 2.0% |
| NaOCl (13%) | 8.0% |
| B | |
| NaOH (50%) | 28.0% |

Upon mixing, a crystal matrix formed which did not gel.

EXAMPLE 44

| | |
|---|---|
| A | |
| Deionized water | 48.5% |
| Potassium tripolyphosphate | 2.0% |
| Sodium tripolyphosphate | 11.5% |
| NaOH (50%) | 2.0% |
| NaOCl (13%) | 8.0% |
| B | |
| NaOH (50%) | 28.0% |

Upon mixing, a combination crystal matrix gel occurred forming a suitable paste with no water cap.

EXAMPLE 45

| | |
|---|---|
| A | |
| Deionized Water | 20.0% |
| Potassium Tripolyphosphate | 15.0% |
| Sodium Tripolyphosphate | 5.0% |
| B | |
| NaOH (50%) | 60.0% |

Upon mixing, this set slowly and became a soft paste after approximately one hour.

EXAMPLE 46

| | |
|---|---|
| A | |
| Deionized Water | 22.5% |
| Potassium Tripolyphosphate | 15.0% |
| Sodium Tripolyphosphate | 12.5% |
| B | |
| NaOH (50%) | 50.0% |

Upon mixing, a firm paste formed. This set up quickly.

Thus in the present invention, the level of sodium hydroxide in the final detergent composition can be varied from about 5% to about 45%. The NaOH concentration in the second solution "B" can vary from about 15% sodium hydroxide to 50% at which point the sodium hydroxide would solidify. The concentration of potassium tripolyphosphate in the first solution can vary from about 1% to about 70% and is preferably at least 2%. The formed detergent can have a variety of different consistencies from that of a relatively loose paste up to a very firm paste.

Using this method, detergent compositions can be formed in a variety of different manners. This in turn enables the detergent of the present invention to take on a variety of different formats providing many different advantages depending on the particular needs.

The preceding has been a description of the present invention as well as the preferred method of practicing the invention currently known. However, the invention should be defined only by the following claims wherein we claim:

1. A method of forming a paste detergent composition said method comprising combining a first aqueous solution comprising a concentration of 1 to 70% by weight of potassium tripolyphosphate with a second aqueous solution having a concentration of a water soluble sodium based detergent builder selected from the group consisting of sodium hydroxide, sodium silicate, sodium metasilicate, sodium carbonate, sodium phosphate, sodium sulfate, sodium borate and sodium chloride and without any potassium tripolyphosphate to form said detergent composition, wherein the concentration of said potassium tripolyphosphate and the concentration of the sodium based detergent builder are effective to cause the formation of a paste detergent.

2. The method claimed in claim 1 wherein said first aqueous solution includes additional detergent builders.

3. The method claimed in claim 2 wherein said second solution is a solution of sodium hydroxide.

4. The method claimed in claim 3 wherein said concentration of sodium hydroxide is from about 15% to about 50% of said second solution.

5. The method claimed in claim 1 wherein said first and second solutions are mixed at room temperature.

6. The method claimed in claim 1 wherein said first solution is combined with said second solution in a container without any additional mixing.

7. The method claimed in claim 1 wherein said first and second solutions are combined in the discharge barrel of an extruder and said detergent composition is extruded from said extruder as a paste.

8. A method of forming a detergent claimed in claim 1 wherein said concentration of potassium tripolyphosphate is at least 2% by weight of the total detergent composition.

9. The method claimed in claim 1 wherein the concentration of potassium tripolyphosphate is at least 3% by weight of the detergent composition.

10. The method claimed in claim 1 wherein said concentration of potassium tripolyphosphate is at least 8% of the detergent composition.

11. The method claimed in claim 1 wherein said second solution comprises an aqueous solution of sodium hydroxide having a concentration by weight of 5–45% sodium hydroxide.

12. A method of forming a paste detergent composition by combining a first aqueous mixture with a second aqueous mixture to form said detergent;

said first aqueous mixture comprising water and 1 to 70% by weight of potassium tripolyphosphate and optionally additional sodium based and potassium based water soluble compositions;

said second aqueous mixture comprising water and a concentration of at least one water soluble sodium composition selected from the group consisting of sodium hydroxide, sodium silicate, sodium metasilicate, sodium carbonate, sodium phosphate, sodium sulfate, sodium borate and sodium chloride wherein said detergent is formed by combining said first mixture with said second mixture wherein the potassium tripolyphosphate in said first mixture and the concentration of said sodium composition causes formation of a paste detergent.

13. The method claimed in claim 12 wherein the water soluble sodium composition is selected from the group consisting of sodium hydroxide, sodium silicate, sodium metasilicate, sodium carbonate, and sodium chloride.

14. The method claimed in claim 13 wherein said sodium based water soluble composition is sodium hydroxide.

15. The method claimed in claim 14 wherein the second solution comprises 15–50% sodium hydroxide.

16. The method claimed in claim 15 wherein the formed detergent comprises from about 5% to about 45% by weight of sodium hydroxide.

17. The method claimed in claim 13 wherein said first solution further includes additional detergent builders selected from the group consisting of sodium phosphate, sodium silicate, sodium metasilicates, and sodium carbonates.

18. The method claimed in claim 17 wherein said additional detergent compositions comprise less than 25% by weight of said first solution.

19. A method of forming a detergent composition comprising forming an aqueous solution comprising 1% to 70% potassium tripolyphosphate and additional water soluble sodium based detergent building compositions;

forming a second aqueous solution comprising 15–50% of sodium hydroxide;

combining said first and said second solution whereby the potassium tripolyphosphate and said sodium hydroxide when combined substantially increase the viscosity of the formed detergent.

* * * * *

UNITED STATES PATENT AND TRADEMARK OFFICE

CERTIFICATE OF CORRECTION

PATENT NO. : 5,061,392

DATED : October 29, 1991

INVENTOR(S) : Anthony J. Bruegge et al

It is certified that error appears in the above-identified patent and that said Letters Patent is hereby corrected as shown below:

| Col. | Line | |
|---|---|---|
| 4 | 68 | after "about" insert --5%-- |
| 5 | 3 | delete "1.00°C." insert therefor --100°C-- |
| 11 | 33 | delete "Example 22" insert therefor --Example 23-- |
| 13 | 35 | insert --Example 33-- |

Signed and Sealed this

Fifteenth Day of June, 1993

Attest:

Michael K. Kirk

MICHAEL K. KIRK

Attesting Officer

Acting Commissioner of Patents and Trademarks